US007623804B2

(12) United States Patent
Sone et al.

(10) Patent No.: US 7,623,804 B2
(45) Date of Patent: Nov. 24, 2009

(54) FIXING DEVICE OF IMAGE FORMING APPARATUS

(75) Inventors: Toshihiro Sone, Kanagawa-ken (JP); Osamu Takagi, Tokyo (JP); Satoshi Kinouchi, Tokyo (JP); Yoshinori Tsueda, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 446 days.

(21) Appl. No.: 11/384,552

(22) Filed: Mar. 20, 2006

(65) Prior Publication Data

US 2007/0217836 A1 Sep. 20, 2007

(51) Int. Cl.
*G03G 15/20* (2006.01)

(52) U.S. Cl. ..... 399/69

(58) Field of Classification Search ..... 399/33, 399/69, 320, 328

See application file for complete search history.

(56) References Cited

U.S. PATENT DOCUMENTS 5,819,136 A * 10/1998 Tomita et al. ..... 399/69
6,684,037 B2 * 1/2004 Tamaoki ..... 399/69
6,964,515 B2 * 11/2005 Asakura et al. ..... 399/69 X
2005/0031363 A1 * 2/2005 Nishi ..... 399/69

FOREIGN PATENT DOCUMENTS

| | | |
|---|---|---|
| JP | 07-104608 | 4/1995 |
| JP | 07-160143 | 6/1995 |
| JP | 2003-057989 | 2/2003 |

* cited by examiner

*Primary Examiner*—Sandra L Brase
(74) *Attorney, Agent, or Firm*—Turocy & Watson, LLP

(57) ABSTRACT

The fixing device of the image forming apparatus of the present invention is provided with a heat transfer probe which contacts the heat roller and a surface temperature of the heat roller is transferred thereto. The erroneous detection of the surface temperature of the heat roller caused from materials adhered to the heat roller is prevented, induction heating coils is regulated at a high level of accuracy using the highly precious detection result obtained from the heat transfer probe, the temperature control of the heat roller is promoted and a fixed image of high quality is obtained.

20 Claims, 6 Drawing Sheets

FIXING DEVICE OF IMAGE FORMING APPARATUS

FIELD OF THE INVENTION

The present invention relates to a fixing device that is mounted in such image forming apparatus as copying machines, printers, facsimiles and so on for heating and fixing toner images.

DESCRIPTION OF THE BACKGROUND

As a fixing device used in image forming apparatus such as electro-photographic copying machines, printers, there is a fixing device to heat, pressurize and fix toner images by inserting sheet paper between a roller pair comprising a heat roller and a pressure roller or similar belts. In this heating type fixing device, in order to maintain a heat roller at a constant temperature for fixing toner images, a surface temperature of the heat roller is detected by a temperature sensor and a heat source is controlled by turning it ON/OFF according to the detected result.

In recent years, a non-contact type temperature sensor is used, which detects temperature without contacting heating units such as heat rollers, fixing belts like a non-contact type infrared temperature sensors without contacting heating units like heat rollers, fixing belts and so on. Especially, a thermopile infrared temperature sensor is in a structure with a calorific capacity of temperature contact portion of a thin film thermocouple made small and the temperature response is high. As a result, it becomes possible to make the temperature control of the heating units precisely and rapidly.

However, if dirt is adhered on objects for temperature detection, such the non-contact type temperature sensor detects not only the surface temperature of objects but also the temperature of adhered dirt. Therefore, an accurate temperature of object cannot be obtained and erroneous temperatures may be detected. Furthermore, after fixed and cleaned, dirt and dust such as scattered toner, paper dust may be adhered on the surfaces of heating units. Accordingly, when detecting the surface temperatures of heating members of the fixing device by a non-contact type temperature sensor, erroneous temperatures including those of dirt adhered on the heating units may be detected. As a result, temperatures of heating members cannot be controlled accurately and improper fixing may possibly result.

So, in the field of a fixing device to detect surface temperatures of heating members with non-contact type temperature sensors, the development of a fixing device capable of improving fixing efficiency and obtaining high image quality by detecting temperatures of heating members precisely and accurately controlling temperatures of heating members even when there are dirt adhered on heating members is so far desired.

SUMMARY OF THE INVENTION

An object of the present invention is to transfer the surface temperatures of heating members and detect the surface temperatures of heat transfer members with non-contact type infrared temperature sensors in a fixing device to detect surface temperature of heating member. Thus, the surface temperatures of heating members are controlled precisely even when there are dirt adhered on the surface and the temperatures of the heating members are precisely controlled and high image quality by good fixing efficiency is obtained.

According to the embodiments of the present invention, there is provided a fixing device of an image forming apparatus comprising a heating member to fix a toner image on a fixing medium by contacting the fixing medium; a heat source member to heat the heating member; a heat transfer member contacts the heating member and a surface temperature of the heating member is transferred thereto; and a non-contact temperature detecting member to detect the surface temperature of the heat transfer member.

DETAILED DESCRIPTION OF THE INVENTION

Figure 1:
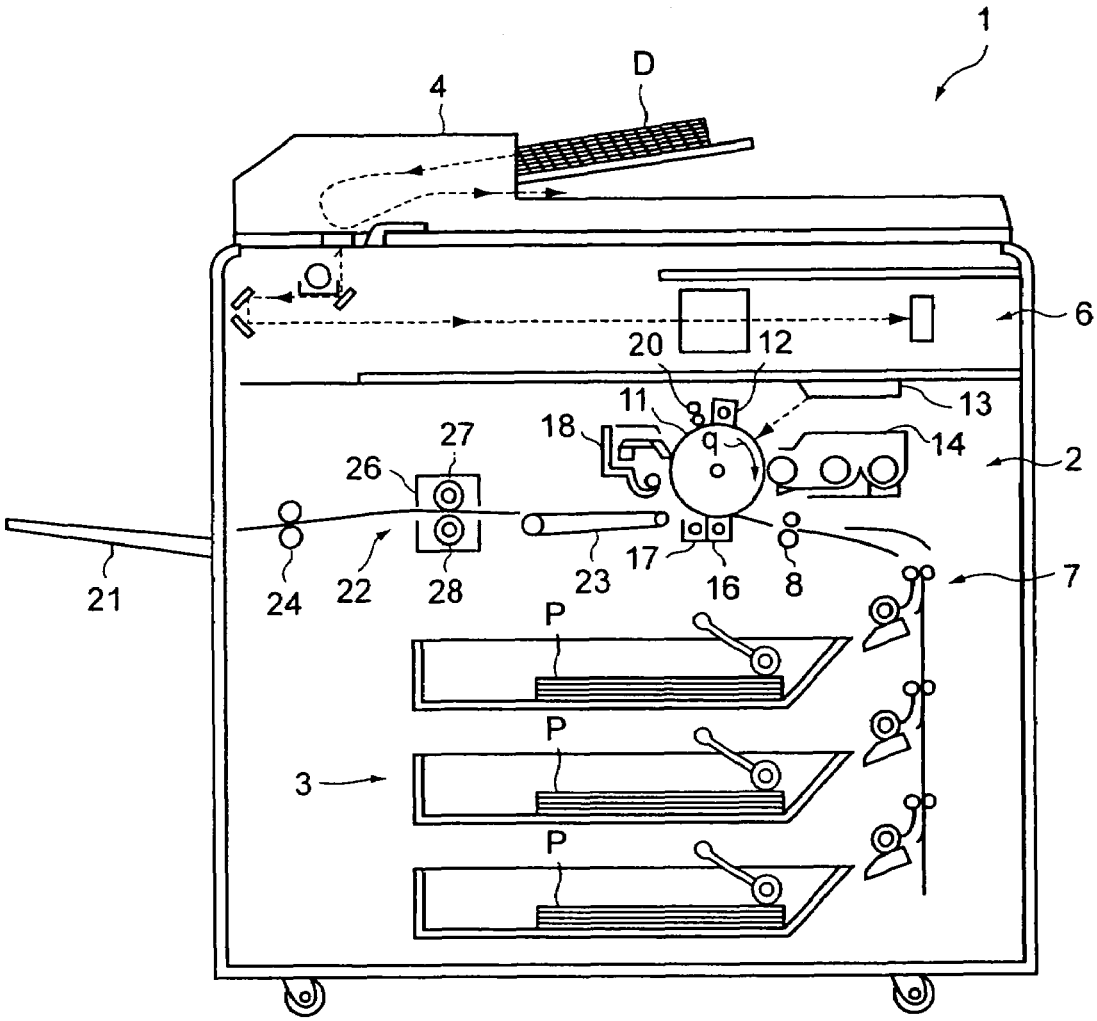
FIG. 1 is a schematic construction diagram showing an image forming apparatus in a first embodiment of the present invention.

The embodiments of the present invention will be explained below in detail referring to the attached drawings. FIG. 1 is a schematic construction diagram showing an image forming apparatus 1 equipped with a fixing device 26 in the embodiment of the present invention. Image forming apparatus 1 is equipped with a cassette mechanism 3 to supply paper P that is a fixing medium to an image forming unit 2 and a scanner unit 6 on the top surface to read a document D supplied from an automatic document feeder 4. On a conveying path 7 from cassette mechanism 3 to image forming unit 2, an alignment roller 8 is provided.

Image forming unit 2 has a main charger 12 to uniformly charge a photosensitive drum 11 sequentially in the rotating direction shown by an arrow mark "q" on photosensitive drum 11, a laser exposure unit 13 to form a latent image on charged photosensitive drum 11 based on image data sent from scanner unit 6, a developing unit 14, a transfer charger 16, a separation charger 17, a cleaner 18 and a charge elimination LED 20 around photosensitive drum 11. Image forming unit 2 forms a toner image on photosensitive drum 11 by the image forming process according to a well-known electro-photographic system and transfers it on a paper P.

At the downstream in the conveying direction of paper P of image forming unit 2, a discharged paper conveying path 22 is provided to convey paper with a toner image transferred in the direction of a paper discharge unit 21. On discharged paper conveying path 22, a conveying belt 23 to convey a paper P separated from photosensitive drum 11 to fixing device 26 and a discharge roller 24 to discharge paper P passed through fixing device 26 to discharge unit 21 are provided.

Figure 2:
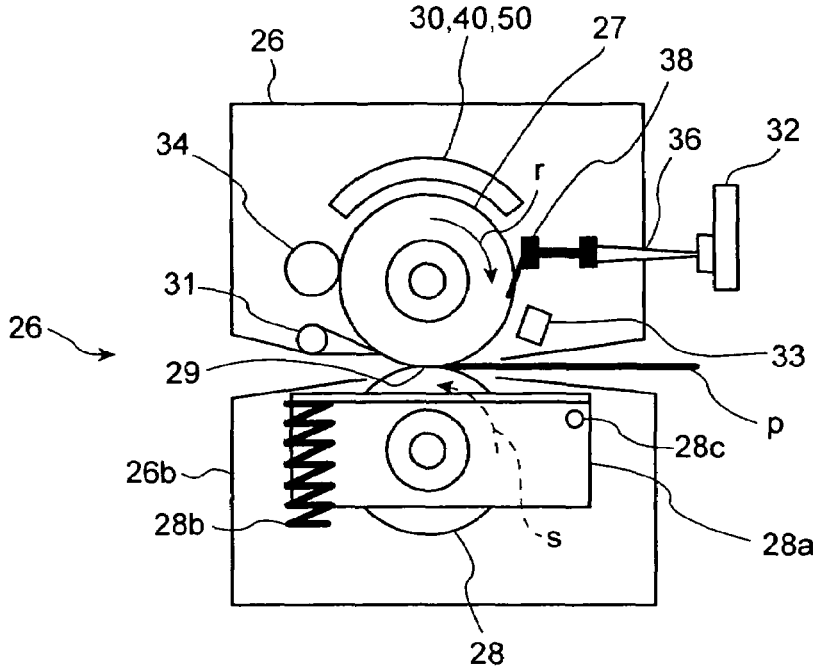
FIG. 2 is a schematic construction diagram of a fixing device viewed from the axial direction of the heat roller in the first embodiment of the present invention.
Figure 3:
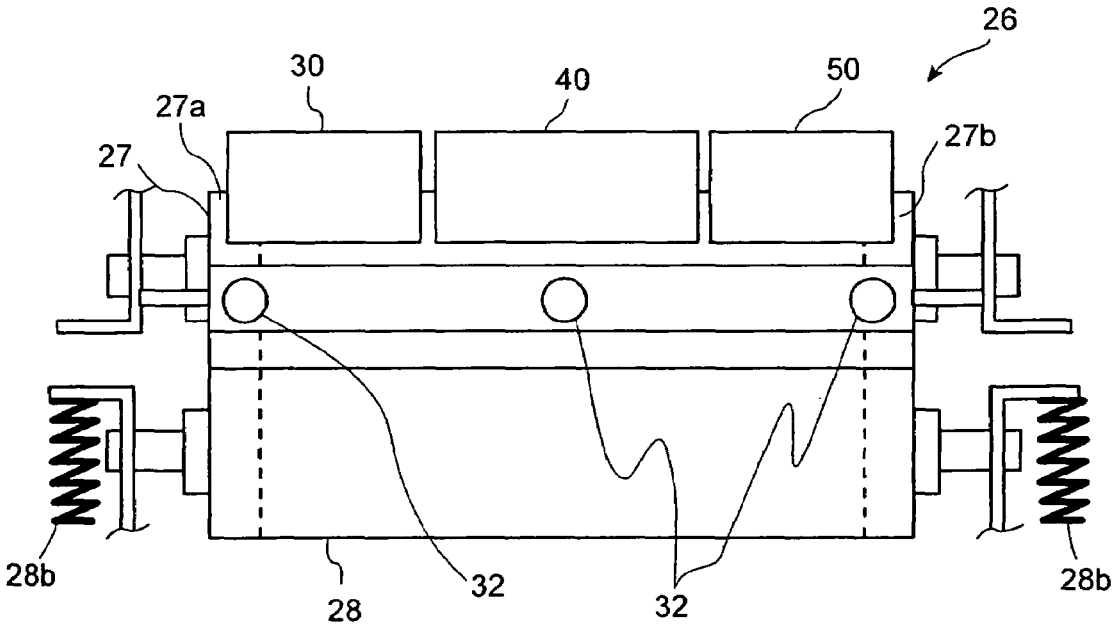
FIG. 3 is a fixing device viewed from the direction orthogonal to the axis of the heat roller in the first embodiment of the present invention.
Figure 4:
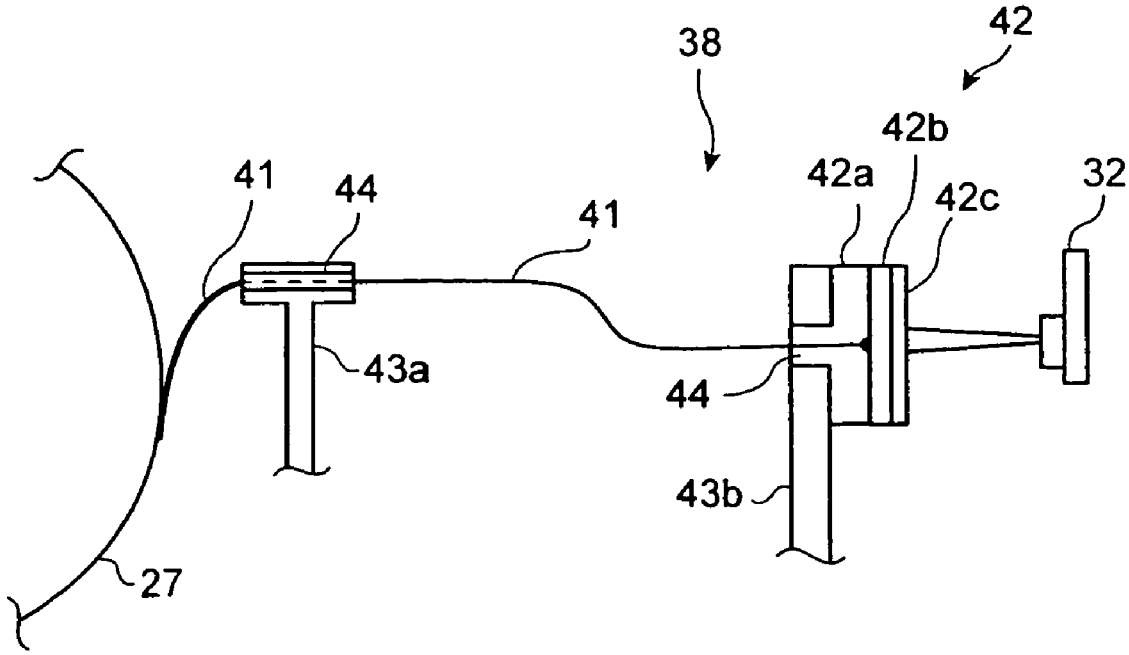
FIG. 4 is a schematic explanatory diagram showing the heat transfer probe in the first embodiment of the present invention.

Next, fixing device 26 will be described. FIG. 2 is a schematic construction diagram showing fixing device 26 viewed from the axial direction of heat roller 27. FIG. 3 is a schematic layout diagram showing fixing device 26 viewed from the direction orthogonal to the axis of heat roller 27, and FIG. 4 is an explanatory diagram of a heat transfer probe that is a teat transfer member. Fixing device 26 is a member to be heated and has a heat roller 27 rotating in the arrow direction "r" and a pressure roller 28 rotating in the arrow direction "s" by pressure contacting heat roller 27. Heat rollers 27 and 28 are a pair of fixing rollers.

Heat roller 27 has a metallic conductive layer formed with a core metal surrounded by foam rubber. Pressure roller 28 has a surface layer covered by silicon rubber or fluoric rubber around a core metal. Pressure roller 28 presses the axis 28*c* against the heat roller 27 side by a pressure spring 28*b* through a pressure arm 28*a*. Thus, pressure roller 28 is press contacted to heat roller 27 and a nip 29 in a specified width is formed between heat roller 27 and pressure roller 28.

Heat roller 27 is supported by upper frame 26*a* and pressure roller 28 is supported by lower frame 26*b*. On the outer surface of heat roller 27, induction heating coils 30, 40 and 50 that are heat source members for 100V power to heat roller 27 with about 1.5 mm gap are provided. Induction heating coils 30, 40 and 50 are in about coaxial shape of heat roller 27.

Induction heating coils 30, 40 and 50 generate a magnetic field, respectively by the supplied driving current and generate eddy current in the metal conductive layer of the surface of heat roller 27 by the magnetic fields and heat roller 27. Induction heating coils 30, 40 and 50 are divided and arranged in the longitudinal direction of heat roller 27 and heat opposing areas of heat roller 27. Power of induction heating coils 30,40 and 50 are controlled corresponding to frequency of driving current and the temperature of heat roller 27 is controlled by varying a calorific power of the metallic conducting layer of heat roller 27 by power of induction heat coils 30, 40 and 50.

Further, on the outer periphery of heat roller 27, a thermistor 33 to shut off the heating by detecting abnormal surface temperature of heat roller 27, a separation claw 31 to prevent winding of paper P after fixed, and a cleaning roller 34 is provided along the rotating direction of arrow mark "r" of heat roller 27. Thermistor 33 contacts the non-image forming areas at both ends of heat roller 27 and detect its temperature.

In openings 36 formed on the outer side of upper frame 26*a*, infrared temperature sensor 32 which is a non-contact temperature detecting member to detect temperature is arranged to each area corresponding to induction heating coils 30, 40 and 50. However, infrared temperature sensors 32 corresponding to induction heat coils 30 and 50 are arranged opposing to non-image forming areas 27*a* and 27*b* at both sides of heat roller 27. Infrared temperature sensor 32 corresponding to induction heat roller 40 is arranged opposing to almost the center of heat roller 27.

Infrared temperature sensor 32 detects the surface temperature of heat transfer probe 38 that is described later. Heat transfer probe 38 is provided between induction heating coils 30, 40 and 50 to nip 29 and transfers the surface temperature of heat roller 27 closer to nip 29 to the outside.

This temperature detecting mechanism comprises heat transfer probe 38 that contacts heat roller 27, a detecting member 42 and temperature sensor 32. Heat transfer probe 38 has a linear terminal 41 using silver having a high heat transfer rate 430 in order to transmit the surface temperature of heat roller 27. The diameter of terminal 41 is less than 30 μm. One end of terminal 41 is contacted to heat roller 27 and a heat detecting member 42 is provided at the another end that is away from heat roller 27.

Terminal 41 is put in a heat resistant tube made of heat-resistant material such as glass, silicon, etc. Thus, the surface temperature of heat roller 27 is transferred almost fully to heat detecting member 42 without generating loss of heat through terminal 41. Further, aluminum having relatively high heat transfer rate and low in price may be used for a terminal. To make it possible to efficiently transfer the surface temperature of heat roller 27, it is more preferred to use a material having higher heat transfer rate than 200 for terminal 41.

Heat detecting member 42 has a surface layer 42*c* made of carbon black having infrared ray emission rate of 95% formed on a middle layer of silver (Ag) provided on a silicon substrate layer 42*a*. Material of surface layer 42*c* is not restricted to carbon black if the heat induction rate from middle layer 42*b* is high and infrared ray emission rate is high. Further, silver of high heat transfer rate may be used with its surface coated in black. When infrared ray emission rate is more than about 90% in black, the detection error by infrared temperature sensors is tolerated.

Terminal 41 is supported in upper frame 26*a* by a first bracket 43*a* near heat roller 27. Further, detecting member 42 is supported in upper frame 26 by a second bracket 43*a*. First and second brackets 43*a* and 43*b* have a heat transfer rate below 1 and made of heat resistance PPS (polyphenylene sulphide) that is a material containing glass material.

Each of portions of first and second brackets 43*a*, 43*b* through which terminal 41 passes is encircled by a silicon ring 44. Accordingly, the surface temperature of heat roller 27 is transferred to middle layer 42 and further, surface layer 42*c* through terminal 41 without almost generating loss of heat. That is, the surface temperature of heat roller 27 is transferred as it is to the surface layer 42*c* of detecting member 42 without scattered toner or paper dust adhered on heat roller 27.

In such the construction as described above, infrared temperature sensor 32 does not directly detect the surface temperature of heat roller 27 but detects the surface temperature of heat roller 27 through the detection of the surface temperature of surface layer 42 by heat transfer probe 38. In other word, infrared temperature sensor 32 is not required to detect the surface heat roller 27 with scattered toner or paper dust adhered.

Figure 5:
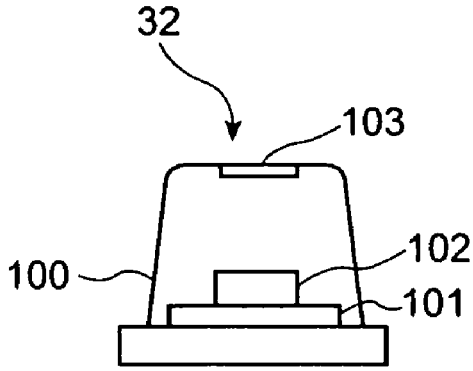
FIG. 5 is a schematic explanatory diagram showing the infrared temperature sensors in the first embodiment of the present invention.

Infrared temperature sensor 32 has a thermopile 102 with many thin film thermocouples comprising polysilicon and aluminum connected in series on a silicon substrate 101 provided in a housing 100 as shown in FIG. 5. Housing 100 has a silicon lens 103 and focuses the infrared ray from heat roller 27 on thermopile 102. A temperature change generated in thermopile 102 by receiving infrared lay is detected as starting power of thermocouples. In infrared temperature sensor 32 in this embodiment is set so that the infrared temperature detecting range becomes $10^{12}$Hz to $5\times10^{14}$Hz.

Next, the operations will be described. When the power source of image forming apparatus 1 is turned ON, driving current is supplied to induction coils 30, 40 and 50, and heat roller 27 is warmed up over the whole area in the scanning direction that is the axial direction. With the warm-up of heat roller 27, terminal 41 of heat transfer probe 38 transfers the surface temperature of heat roller 27 to heat detecting member 42.

In temperature detecting member, the surface temperature of heat roller 27 is transferred to surface layer 42 through middle layer 42*b*. As a result, surface layer 42*c* of the temperature detecting members 42 is heated up to the temperature that is the transferred surface temperature of heat roller 27. That is, when the surface temperature of heat roller 27 is varied, the surface temperature of surface layer 42 of surface heat detecting member 42 to which the surface temperature of heat roller 27 is transferred also changes.

While heat roller 27 is warmed up and heat transfer probe 38 is heated with the warm-up of heat roller 27, thermistor 33 is brought to contact heat roller 27 and detects its surface temperature directly. Further, infrared temperature sensor 32 detects the surface temperature of heat roller 27 by detecting the surface temperature of heat transfer probe 38 which is contacting heat roller 27 at the upstream of nip 29. That is, in order to detect the surface temperature of heat roller 27, infrared temperature sensor 32 detects the surface temperature of surface layer 42*c* of the detecting member 41 of heat transfer probe 38.

Figure 6:
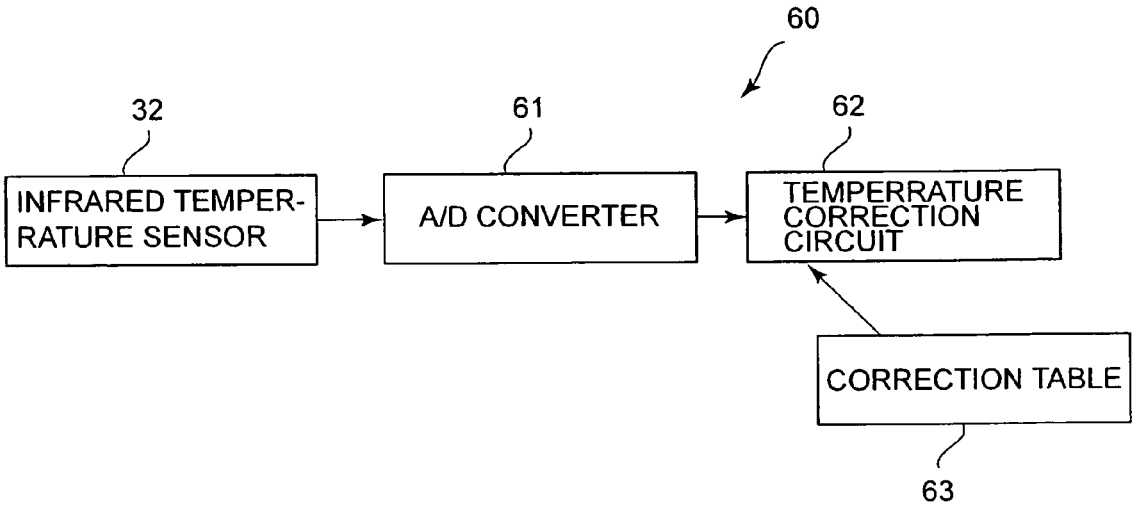
FIG. 6 is a schematic block diagram showing the control system to correct detecting values of the infrared temperature sensors in the first embodiment of the present invention.

After heat roller 27 reaches the ready temperature from the result of detection by infrared temperature sensor 32, the controller of image forming apparatus 1 controls the output power values of induction heating coils 30, 40 and 50 so as to maintain the ready temperature according to the detection results of infrared temperature sensor 32 and thermistor 33. The induction heating coils 30, 40 and 50 is made based on the detection result obtained by correcting the detected value by infrared temperature sensor 32 according to at least the infrared emissivity of the surface layer 42*c*. For correction of a detection value of infrared temperature sensor, a control system 60 shown in FIG. 6 is used.

Control system 60 converts an analog output detected by infrared temperature sensor 32 into digital signals (temperature) by an A/D converter 61. Upon receipt of this digital signal, a temperature correction circuit 62 corrects temperature data of A/D converter 61 in reference to a correction table 63. The corrected result is sent to the main body circuit (not shown) as a temperature of heat roller 27.

Then, the print operation in the ready state is directed and the image forming process is started. In image forming unit 2, photosensitive drum 11 rotating in the arrow direction q is uniformly charged by main charger 12. Further, photosensitive drum 11 is applied with laser beam corresponding to document data by laser exposure unit 13 and a latent image is formed thereon. The latent image is then developed by developing unit 14 and a toner image is formed on photosensitive drum 11.

The toner image formed on photosensitive drum 11 is transferred on a paper P by transfer charger 16. Then, the paper P is separated from photosensitive drum 11 and conveyed to fixing device 26. The paper P conveyed to fixing device 26 is heated to, for example, a fixable temperature 160° C. and inserted between heat roller 27 rotating in the arrow direction r and pressure roller 28 rotating in the arrow direction s and the toner image is heated, pressurized and fixed.

While fixing the toner image, likewise the warm-up time, thermistor 33 directly detect the surface temperature of heat roller 27 immediately before fixing operation at the upstream of nip 29. Infrared temperature sensor 32 detects the surface temperature of heat transfer probe 38 to which the surface temperature of hat roller 27 is transferred by detecting the surface temperature of heat roller 27.

At this time, the surface temperature of heat roller 27 is transferred to surface layer 42*c* of members to be detected 42 of hat transfer probe 38 but toner, dirt, dust, etc. adhered on the surface of heat roller 42 are not transferred. Accordingly, it becomes possible for infrared temperature sensor 32 to detect the surface temperature of surface layer 42*c* of detecting member 42 at a high degree of accuracy without generating erroneous detection by toner, dirt, dust, etc. In other words, even if there is dirt adhered on the surface of heat roller 27. Infrared temperature sensor 32 is able to detect the surface temperature of heat roller at a high degree of accuracy through the surface temperature of heat transfer probe 38 without detecting the dirt.

While executing the image forming process, the controller of image forming apparatus 1 regulates supply power to induction heating coils 30, 40 and 50 to 160° C. and maintains the coils at this level accurately according to the detection result of infrared temperature sensor 32. Thus, a toner image is satisfactorily fixed on a paper P.

Further, when detects any abnormal condition, thermistor 33 turns off supply power to induction heating coils 30,40 and 50 immediately. After competing the specified image forming process, the controller controls output power values of induction heating coils 30, 40 and 50 according to the detection result of the surface temperature of heat transfer probe 39 by infrared temperature sensor 32 and maintains heat roller 27 in the ready state.

Next a second embodiment of the present invention will be explained. In this second embodiment, the surface temperature of heat roller 27 is transferred to heat transfer roller instead of the heat transfer probe as in the first embodiment described above. Accordingly, in this second embodiment, the same constructions as the constructions described in the first embodiment will be assigned with same reference numerals and their detailed explanations are omitted.

Figure 7:
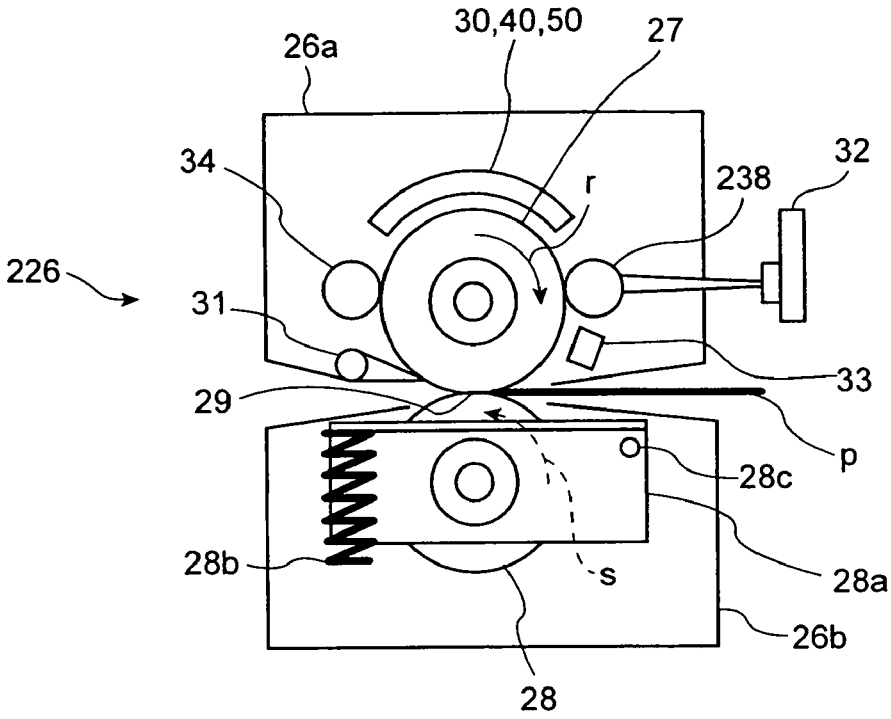
FIG. 7 is a schematic construction diagram showing the fixing device viewed from the axial direction of the heat roller in the second embodiment of the present invention.
Figure 8:
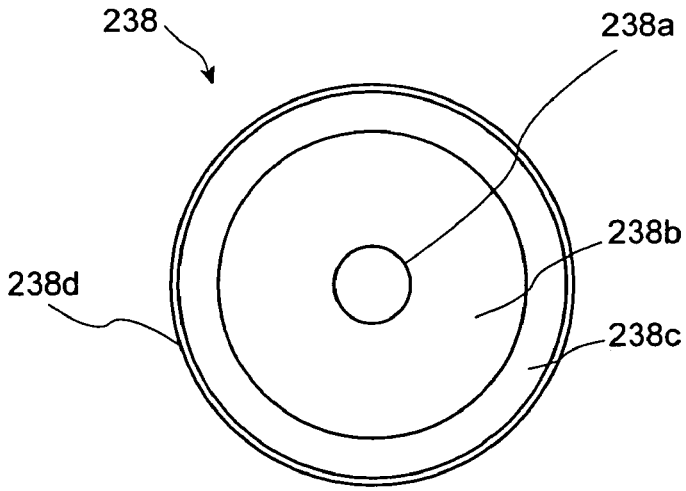
FIG. 8 is a schematic construction diagram showing a heat transfer roller in the second embodiment of the present invention.
Figure 9:
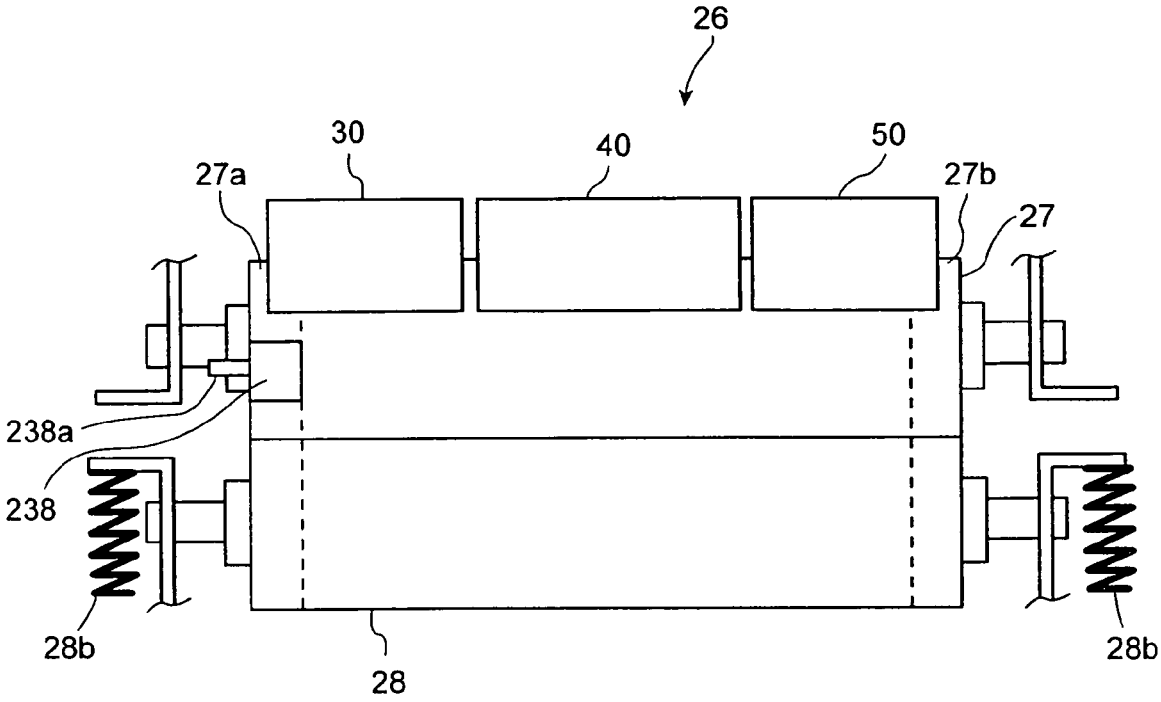
FIG. 9 is a schematic layout diagram of the fixing device viewed from the direction orthogonal to the axis of the heat roller in the second embodiment of the present invention.

In fixing device 226 in this embodiment, thermopile infrared temperature sensor 32 is arranged oppositely in the non-image forming area 27*a* of one side of heat roller 27 as shown in FIG. 9. Thermopile infrared temperature sensor 32 is able to detect the surface temperature of heat roller without contacting it via heat transfer roller 238 rotating in contact with heat roller 27 as shown in FIG. 7. Heat transfer roller 238 is composed of a heat transfer layer 238*c* and a surface layer 238*d* laminated around a heat insulating layer 238*d* provided on a shaft 238*a* as shown in FIG. 8.

Shaft 238*a* is made of heat resistance PPS that is material containing glass and has a heat conductivity less than 1 and heat insulating layer 238*b* is made of silicon rubber. Heat transfer layer 238*c* is made of, for example, aluminum and surface layer 238*b* is made of carbon black. Further, on the surface of shaft 238*a* is coated with separation agent such as silicon oil, etc. to prevent transfer of adhering dirt, dust, etc. on heat roller 27.

In the construction described above, infrared temperature sensor 32 does not detect the heat roller 27 but detects the surface temperature of heat roller 27 by detecting the surface temperature of surface layer 238 of heat transfer roller 238. That is, infrared temperature sensor 32 is not needed to detect the surface of heat roller on which scattered toners and paper dust are adhered.

In image forming apparatus 1 equipped with fixing device 226, when the power source is turned ON, driving current is supplied to induction heating coils 30, 40 and 50 and heat roller 27 is warmed up over he whole area in the scanning direction that is an axial direction. With the warm-up of heat roller 27, the surface temperature of heat roller 27 is transferred to heat transfer roller 238 and the surface temperature of heat roller 27 is heated to the transferred temperature by heat transfer roller 238. That is, when the surface temperature of heat roller 27 is varied, the surface temperature of heat transfer roller 238 to which the surface temperature of heat roller is transferred is also varied.

While heat roller 27 is warmed up and heat transfer roller 238 is heated, thermistor 33 is contacted to heat roller 27 and detects its surface temperature directly. Further, infrared temperature sensor 32 detects the surface temperature of heat roller 27 by detecting the surface temperature of heat transfer roller 238 that is in contact with heat roller 27 at the upstream of nip 29. That is, infrared temperature sensor 32 detects the surface temperature of heat roller 27 and therefore, detects the surface temperature of the surface layer 238*d* of heat transfer roller 238.

After heat roller 27 reaches the ready temperature from the detection result by infrared temperature sensor, the controller of image forming apparatus controls the output power values of induction heating coils 30, 40 and 50 so as to maintain the ready temperature according to the detection results of infrared temperature sensor and thermistor 33. Further, since infrared ray emissivity of surface layer 238*d* of heat transfer roller 238 is 95%, output power values of induction hear coils 30, 40 and 50 is controlled based on the detection result obtained by correcting the detected values by infrared temperature sensor 32 at least according to the infrared ray emissivity of surface layer 238*d*.

Further, likewise the warm-up at the time of image forming process, infrared temperature sensor 32 detects the surface temperature of heat transfer roller 238. Based on the thus obtained detection result, the controller of image forming apparatus 1 regulates supply power to induction heating coils 30, 40 and 50 and maintains the surface temperature of heat roller 27 at 160° C.±10° C. precisely. Accordingly, a paper P with a toner image fixed reaches fixing device 226 is inserted into nip 29 between heat roller 27 kept precisely at 160° C.±10° C. and pressure roller 28 and the toner image is heated, pressurized and fixed.

According to this embodiment, infrared temperature sensor 32 detects the surface temperature of heat roller 27 by detecting the surface temperature of heat transfer roller 238 without toner, dirt, dust adhered although the surface temperature of heat roller 27 is transferred. As a result, even when the surface of heat roller 27 is contaminated, infrared temperature sensor 32 detects the surface temperature of surface layer 42*c* of heat transfer roller 238 without toner, dirt, dust adhered. Accordingly, the highly accurate detection result is obtained by infrared sensor 32 without generating detection error by the detection of adhered materials. Thus, by regulating supply power of induction heating coils 30, 40 and 50 accurately, it becomes possible to control the temperature of heating roller 27 at a high level of accuracy and obtain a high quality by the satisfactory fixing. Furthermore, as heat transfer roller 238 is arranged only at the contacting position between heat roller 27 and non image forming area 27*a*, there is no possibility to damage the image forming area of heat roller 27.

Further, the application of the present invention is not restricted to the embodiments described above but can be varied variously within the scope of the invention, for example, kinds of non-contact temperature detectors or response times, etc. are not limited. Further, in the first embodiment, the layout position of detecting member 42 may be arrange at an optional location if it is away from heat roller 27 and for example, terminal 41 is extended and detecting unit 42 may be arranged at the outside of upper frame 26*a*. This will prevent adhesion of scattering toner, paper dust, etc. more certainly. Further, the shape, material and arranging position, etc. of heat transfer member are optional if its surface temperature can be transferred. Furthermore, heat sources are not restricted to induction heating coils but the heating may be made using a heater and induction heating coils may be provided in the inside of heating members.

What is claimed is:

1. A fixing device of an image forming apparatus comprising:

a heating member to fix a toner image on a fixing medium by contacting the fixing medium;

a heat source member to heat the heating member;

a heat transfer member contacts the heating member and a surface temperature of the heating member is transferred thereto; and a non-contact temperature detecting member to detect the surface temperature of the heat transfer member.

2. The fixing device of the image forming apparatus according to claim 1, wherein the heating member includes a fixing roller pair to which the fixing medium is inserted to fix the toner image.

3. The fixing device of the image forming apparatus according to claim 1, where the temperature detecting member is a non-contact thermopile type infrared temperature sensor.

4. The fixing device of the image forming apparatus according to claim 3, wherein the temperature detecting range of the infrared temperature sensor is $10^{12}$ Hz to $5\times10^{14}$ Hz.

5. The fixing device of the image forming apparatus according to claim 3, wherein the infrared ray emissivity of the area detected by the infrared temperature sensor of the heat transfer member is more than 0.79.

6. The fixing device of the image forming apparatus according to claim 3, wherein the area detected by the infrared temperature sensor of the heat transfer member is made of carbon black.

7. The fixing device of the image forming apparatus according to claim 1, wherein the heat transfer member is a heat transfer probe.

8. The fixing device of the image forming apparatus according to claim 7, wherein the heat transfer probe is covered by a heat resistance member.

9. The fixing device of the image forming apparatus according to claim 1, wherein the temperature detecting member is provided at the outside of a housing supporting the heating member.

10. A fixing device of an image forming apparatus comprising;

heating means for fixing a toner image on a fixing medium by contacting the fixing medium;

heat source means for heating the heating means;

heat transferring means contacting with the heating means for being transferred a surface temperature of the heating means; and temperature detecting means for detecting the surface temperature of the heat transferring means without contacting.

11. The fixing device of the image forming apparatus according to claim 10, wherein the heating means includes a fixing roller pair to which the fixing medium is inserted to fix the toner image.

12. The fixing device of the image forming apparatus according to claim 10, wherein the temperature detecting means is a non-contact thermopile type infrared temperature sensor.

13. The fixing device of the image forming apparatus according to claim 12, wherein the temperature detecting range of the infrared temperature sensor is $10^{12}$Hz to $5\times10^{14}$Hz.

14. The fixing device of the image forming apparatus according to claim 12, wherein the infrared ray emissivity of the area detected by the infrared temperature sensor of the heat transferring means is more than 0.79.

15. The fixing device of the image forming apparatus according to claim 12, wherein the area detected by the infrared temperature sensor of the heat transferring means is made of carbon black.

16. The fixing device of the image forming apparatus according to claim 10, the heat transferring means is a heat transfer probe.

17. The fixing device of the image forming apparatus according to claim 16, wherein the heat transfer probe is covered by a heat resistance member.

18. The fixing device of the image forming apparatus according to claim 10, wherein the temperature detecting means is provided at the outside of a housing supporting the heating means.

19. A fixing method in an image forming apparatus comprising:

contacting a heating member to fix a toner image on a fixing medium;

heating the heating member by a heat source;

contacting a heat transfer member with the heating member and transferring a surface temperature of the heating member to the heat transfer member; and detecting the surface temperature of the heat transfer member with a non-contact detecting member.

20. The method according to claim 19, wherein the heating member includes a fixing roller pair to which the fixing medium is inserted to fix the toner image.

* * * * *